US005880680A

United States Patent [19]

Wisehart et al.

[11] Patent Number: 5,880,680

[45] Date of Patent: Mar. 9, 1999

[54] APPARATUS AND METHOD FOR DETERMINING BORING DIRECTION WHEN BORING UNDERGROUND

[75] Inventors: John C. Wisehart, Stillwater; Austin L. Widener; Jian Jin, both of Perry, all of Okla.

[73] Assignee: The Charles Machine Works, Inc., Perry, Okla.

[21] Appl. No.: 759,656

[22] Filed: Dec. 6, 1996

[51] Int. Cl.[6] ..... G01V 3/00

[52] U.S. Cl. ..... 340/853.4; 340/853.1; 340/853.5; 175/61; 175/26; 73/152.46

[58] Field of Search ..... 73/152.43, 152.44, 73/152.45, 152.46; 175/26, 45, 61; 340/853.1, 853.3, 853.5, 853.6, 853.4

[56] References Cited

U.S. PATENT DOCUMENTS

| | | | |
|---|---|---|---|
| 3,753,296 | 8/1973 | Van Steenwyk | 33/304 |
| 4,013,945 | 3/1977 | Grosso | 324/34 |
| 4,171,115 | 10/1979 | Osder | 244/181 |
| 4,231,252 | 11/1980 | Cherkson | 73/151 |
| 4,399,692 | 8/1983 | Hulsing, II et al. | 73/151 |
| 4,452,075 | 6/1984 | Brockhorst et al. | 340/853.6 |
| 4,461,088 | 7/1984 | Van Steenwyk | 33/304 |
| 4,512,192 | 4/1985 | Peters | 73/505 |
| 4,522,062 | 6/1985 | Peters | 73/505 |
| 4,637,479 | 1/1987 | Leising | 175/26 |
| 4,682,421 | 7/1987 | van Dongen et al. | 33/302 |
| 4,709,486 | 12/1987 | Walters | 33/304 |
| 4,813,274 | 3/1989 | DiPersio et al. | 73/151 |
| 4,854,397 | 8/1989 | Warren et al. | 175/26 |
| 4,875,014 | 10/1989 | Roberts et al. | 73/152.46 |
| 5,034,929 | 7/1991 | Cobern et al. | 73/152.46 |
| 5,128,867 | 7/1992 | Helm | 364/566 |
| 5,142,485 | 8/1992 | Rosenberg et al. | 364/422 |
| 5,307,325 | 4/1994 | Scheiber | 367/178 |
| 5,341,681 | 8/1994 | Molney et al. | 73/382 |
| 5,341,682 | 8/1994 | Hulsing, II | 73/505 |
| 5,433,110 | 7/1995 | Gertz et al. | 73/517 |
| 5,435,069 | 7/1995 | Nicholson | 33/304 |
| 5,456,109 | 10/1995 | Lautzenhiser et al. | 73/514.03 |
| 5,467,083 | 11/1995 | McDonald et al. | 340/854.4 |
| 5,513,710 | 5/1996 | Kuckes | 175/61 |
| 5,585,726 | 12/1996 | Chau | 340/853.5 |

FOREIGN PATENT DOCUMENTS 2086055 5/1982 United Kingdom .

OTHER PUBLICATIONS

Analog Devices, Inc., 1995, ±1g to ±5g Single Chip Accelerometer with Signal Conditioning ADXL05, Norwood, MA, pp. 1–19.

Mike Schuster, Jul. 19, 1993, ADLX50 Header Package: Maximum Theta Alignment Error Analysis, Norwood, MA. No page numbers.

Charles Kitchen and Paul Brokaw, AN–380 Application Note: Compensating for 0g Offset Drift of the ADXL50 Accelerometer, Norwood, MA. No page number.

*Primary Examiner*—Michael Horabik
*Assistant Examiner*—Timothy Edwards, Jr.
*Attorney, Agent, or Firm*—McKinney & Stringer, P.C.

[57] ABSTRACT

A guidance module for an underground horizontal boring assembly. The module determines the pitch angle of the boring tool independent of roll using a single accelerometer sensor. The accelerometer sensor has a single sensitive axis which is aligned parallel to, and preferably coaxial with, the longitudinal axis of the boring tool. The accelerometer sensor is calibrated to obtain a temperature offset and a gain compensating gain factor. Data samples are read from the accelerometer sensor while the boring tool is rotating. The temperature is read from the temperature sensor. The data samples from the accelerometer sensor and the temperature from the temperature sensor are transmitted to a processor. The processor applies simple average filtering to the accelerometer data samples to get an average result, and adjusts the average result for gain. The average result is adjusted for the temperature offset and for the gain compensating gain factor. The average result then can be adjusted for an optional roll angle offset. The pitch angle is determined either from a lookup table or from the arcsin value of the quantity of the average result minus the temperature offset divided by the gain compensating gain factor.

78 Claims, 7 Drawing Sheets

APPARATUS AND METHOD FOR DETERMINING BORING DIRECTION WHEN BORING UNDERGROUND

FIELD OF THE INVENTION

The present invention relates generally to the field of underground boring and, in particular, to methods and apparatus for determining the boring direction of a boring tool when boring horizontally underground.

SUMMARY OF THE INVENTION

The present invention comprises a guidance module for use in the boring tool of a horizontal underground boring assembly which includes an output device for presenting directional information received from the guidance module. The guidance module comprises an accelerometer sensor that has a single sensitive axis which is aligned coaxially with the longitudinal axis of the boring tool. The accelerometer sensor is adapted to sense a plurality of pitch data samples of the boring tool between a horizontal plane and the axis of the boring tool and to transmit the pitch data samples in a pitch signal. The module further comprises a temperature sensor that is adapted to measure temperature near the accelerometer and to transmit the temperature in a temperature signal. Still further, the module comprises a processor adapted to receive the pitch signal from the accelerometer sensor and the temperature signal from the temperature sensor, to process the temperature in the temperature signal to determine a temperature offset, and to process the pitch data samples from the pitch signal with the temperature offset to determine a pitch angle. The processor is adapted to transmit an output signal containing the pitch angle to an output device.

Further, the present invention comprises a boring tool for use in an underground horizontal boring assembly, which assembly includes an output device for presenting directional information received from the boring tool. The boring tool of this invention is equipped with the above described guidance module.

Further still, the present invention comprises a boring assembly for underground horizontal boring. The boring assembly comprises a boring tool and a control system which includes a drive system for driving the boring tool through the earth, a steering system for controlling the direction of the boring tool as it is driven through the earth, and an output device for receiving directional information from the boring tool. The boring tool is equipped with the above described guidance module.

In yet another aspect, the present invention is directed to a method for determining boring direction when boring underground with a boring assembly having a boring tool with a longitudinal axis. Pitch data samples representative of a pitch angle of the boring tool between a horizontal plane and the axis of the boring tool are sensed in an accelerometer sensor. A temperature sample is sensed near the accelerometer. A compensating gain factor is determined. A temperature offset is determined using the temperature sample. The pitch data samples are then averaged. The pitch data samples are processed with the temperature offset and the compensating gain factor to determine a pitch angle.

Further still, the present invention is directed to a method for determining boring direction when boring underground with a boring tool that has a longitudinal axis. The method comprises sensing with only one accelerometer sensor pitch data samples of the boring tool between a horizontal plane and the axis of the boring tool with a reference to a gravity vector. The only one accelerometer has a single sensitive axis. The pitch data samples are processed to determine a pitch angle.

Still further, the present invention includes a method for boring underground horizontally using a boring assembly which comprises a boring tool with a longitudinal axis. An accelerometer sensor is calibrated, and a plurality of data samples from the accelerometer sensor are read. A temperature is sensed near the accelerometer sensor. The data samples are filtered, and adjusted with a compensating gain factor and with a temperature offset. A pitch angle is determined after the data samples have been filtered and adjusted.

In yet another aspect, the present invention is directed to a method for compensating a gain of a process signal having non-uniform process signal data from an input device. The method comprises reading a first value at a maximum input position and a second value at a minimum input position. A sample peak value of the first value and the second value is determined. A reference peak value and a gain reference setpoint are obtained, and a weighted sample peak value is determined. The sample peak value is compared to the reference peak value. The gain reference setpoint is adjusted to a compensating gain setpoint if the reference peak value is not equal to the sample peak value. The compensating gain setpoint is determined by an iterative adjustment of the gain reference setpoint by a gain adjustment value by iteratively comparing the reference peak value to the sample peak value adjusted by the weighted sample peak value, and thereby iteratively adjusting the compensating gain setpoint for each comparison. The method further comprises outputting the compensating gain setpoint to a processing device having the process signal. In the processing device, the compensating gain setpoint is applied to the process signal to modify the gain of the process signal.

DETAILED DESCRIPTION OF THE PREFERRED EMBODIMENTS

Figure 1:
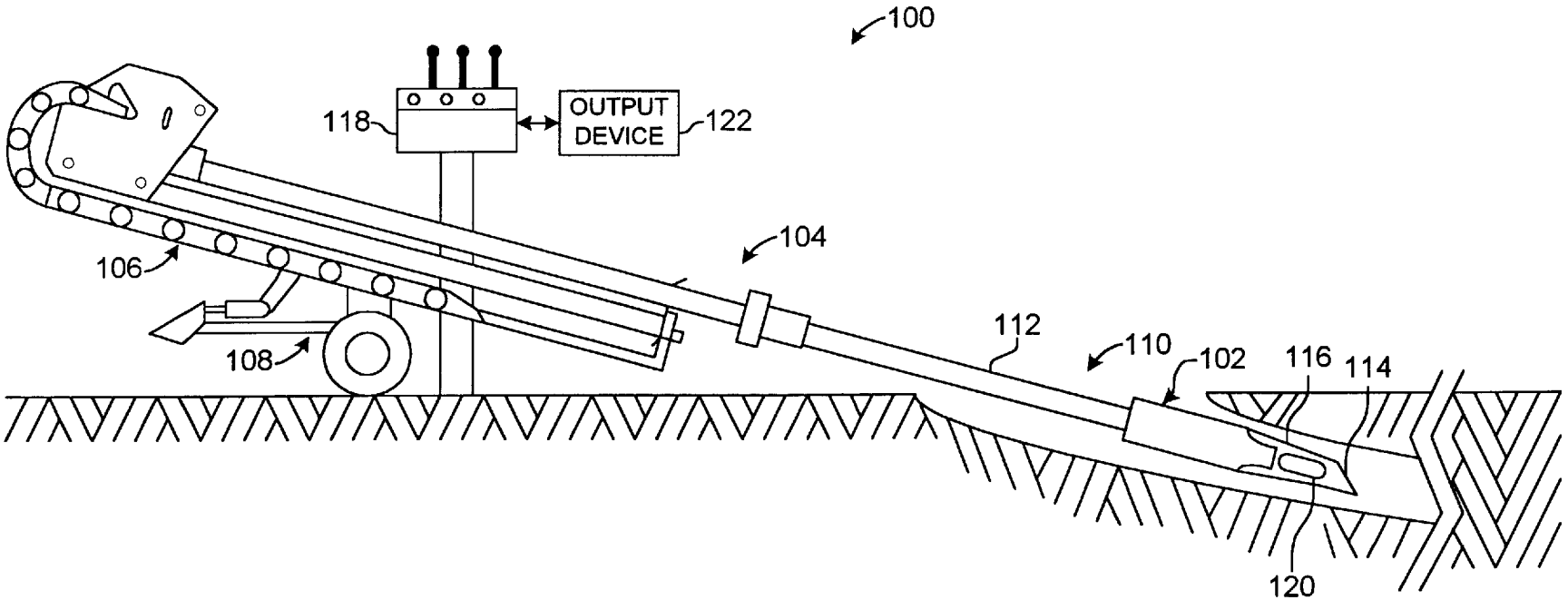
FIG. 1 is a diagrammatic view of a boring assembly attached to a boring tool.

Trenchless underground boring systems have become widely used in a variety of applications, such as utility line installation and replacement, sewer installation, and others. Such underground boring systems reduce the disruption that is associated with open trenches and with trenching technology. For example, underground boring systems are able to bore horizontally under roads and buildings without disrupting the use of the roads and buildings. As used herein, "horizontal boring" refers to boring operations wherein the borehole is directed generally horizontally as opposed to operations which are primarily vertical.

Trenchless boring systems typically comprise a boring tool capable of drilling or piercing the earth. The boring tool is launched from a rig above ground and driven by a variety of mechanisms including rotary boring drilling systems, jacking assemblies and pneumatic and non-pneumatic percussive devices. The boring tool is supported on the end of a drill string or air hose, depending on the drive mechanism. Steering mechanisms have been developed for controlling the direction of the boring tool during the boring operation, and various tracking and locating devices have been used for determining the location, pitch angle, and roll angle of the boring tool in the bore hole.

Steering of the boring tool requires information about the direction of travel of the boring tool. For example, the pitch angle is an important measurement. Generally, the pitch angle is the angle between the longitudinal axis of the boring tool and the horizontal plane, that is, pitch is a measurement of ascent or descent of the tool as it moves through the earth. The pitch angle is part of the directional information used by operators of guided boring systems to guide the boring tool.

In many situations, steering mechanisms used to determine directional information and guide the boring tool incorporate an error factor into the directional information known as a roll angle error. A roll angle is the angle of deviation from a nominal reference orientation or direction. Rotation about the longitudinal axis of the boring tool from the nominal reference orientation provides the roll. The preferred nominal reference orientation is 12:00 on a clock face.

The roll angle error is roll angle dependent pitch angle error. The error can be described as a cone of error scribed around the boring tool axis when the boring tool is rotated. Thus, the roll angle is used as an indication to determine the roll dependent pitch error. As many steering systems, as well as rotary drilling systems, involve continuous or intermittent rotation of the boring tool during the boring operation, the roll angle error may vary widely during the boring operation.

Thus, variations in roll angle can adversely affect the accuracy of the pitch angle determination and, consequently, the accuracy of the steering process. Accordingly, there is a need for a system and method which simply and effectively provide the pitch angle, independent of roll, of the boring tool during a horizontal boring operation.

The present invention provides an improved apparatus and method for determining the direction of a boring tool during a horizontal boring operation. More specifically, this apparatus and method determine the pitch angle of the traveling boring tool independent of roll. The apparatus is compact and sturdy, and, thus, may be employed in any type of horizontal boring assembly.

Turning now to the drawings in general and to FIG. 1 specifically, there is shown therein a boring assembly designated generally by the reference numeral 100 and constructed in accordance with the present invention. The boring assembly 100 generally comprises a boring tool 102 adapted to pierce or drill through the earth. The boring tool 102 is controlled by a control system 104 which steers and drives the boring tool 102. In the boring assembly 100 illustrated in FIG. 1, the control system 104 uses a jacking type drive system 106 supported on a rig or trailer 108 at the launch site 110. The boring tool 102 is connected to the jacking system 106 by means of a drill string 112.

The control system 104 includes a steering system incorporated in the jacking system 106 which intermittently rotates the drill string 112 and the boring tool 102. In the system illustrated, the boring tool has a slanted face 114 on its head 116. Thus, as the boring tool 102 is pushed through the earth, it will go straight (in a spiral pattern) if it is continuously rotated. On the other hand, the boring tool 102 will veer in the direction of the slant face 114, if it is pushed through the earth while not rotating. This system enables the operator to guide the direction of the boring tool 102. Many other steering systems are available, however, and this particular system is used for illustration only.

The control system 104 usually includes a control panel 118 by which the boring operation is controlled. The nature of the control 118 panel may vary widely depending on the type of drive system and steering system employed. In the jacking system 106 illustrated in FIG. 1, the control panel 118 allows the operator to add or remove joints of drill pipe to or from the drill string 112, to rotate the drill string 112 for steering the boring tool 102, and generally to manage the boring operation.

In accordance with present invention, a guidance module 120 is installed in the head 116 of the boring tool 102. The module 120 senses directional data in the boring tool 102 in a manner yet to be described. The module 120 emits a signal receivable by an output device 122 above ground which presents the directional information. Preferably, this directional information is displayed visually. The signal from the guidance module 120 may be transmitted to the output device 122 directly along a transmission line or indirectly by means of a radio frequency transmitter or other wireless device.

In the boring assembly 100 of FIG. 1, the output device 122 is shown schematically as associated with the control panel 118. The output device 122 may be integrated in the control panel 118 so they are used by the same operator. Alternately, the output device 122 may be a separate, hand-held device used by a second operator walking on the ground generally over the boring tool 102. In this embodiment, the second operator will communicate with the control panel operator by means of a two-way radio or some like device. In any event, the operator uses the directional information from the guidance module 120 that is in the boring tool 102 to make the necessary adjustments to the course of the boring tool.

While the particular boring assembly 100 shown in FIG. 1 uses a jacking mechanism, the term "boring assembly" as used herein is intended to include all types of boring systems regardless of the nature of the drive mechanism. Similarly, the term "boring tool" as used herein includes a variety of permanent or replaceable boring heads, including stepped heads, splined heads, slanted heads, and blunt heads. The boring assembly may use any of a number of methods to assist with the boring, such as water assisted boring, compressed air assisted boring, and others. Similarly, other systems are known for steering a boring tool, such as offset pneumatic hammer mechanisms. Thus, "steering system" as used herein is intended to encompass all types of steering mechanisms.

Figure 2:
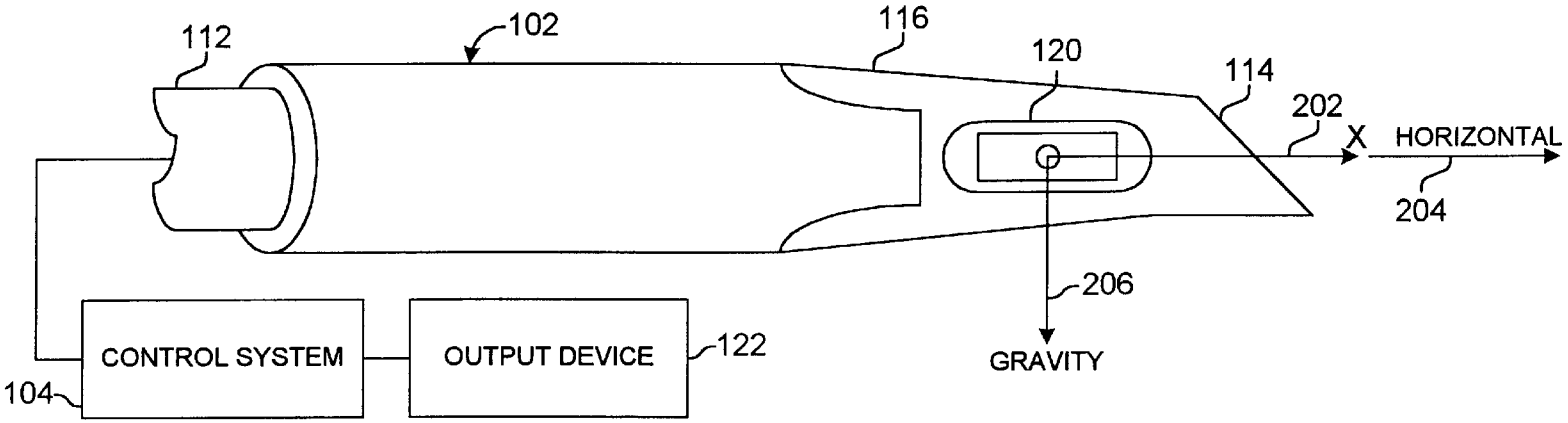
FIG. 2 is a block diagram of a boring tool with sensor electronics connected to a boring assembly.

FIG. 2 illustrates the boring tool 102 of the present invention in a perfectly horizontal position. That is, the longitudinal axis 202 of the boring tool 102 is parallel with the horizontal plane 204. The guidance module 120, which is aligned with the boring tool axis 202, senses the pitch angle of the boring tool 102. As indicated, pitch angle is the angle between the boring tool axis 202 and the horizontal plane 204, and it is measured relative to the gravity vector 206. In the horizontal position of FIG. 2, then, the pitch angle of the boring tool 102 is zero.

Figure 3:
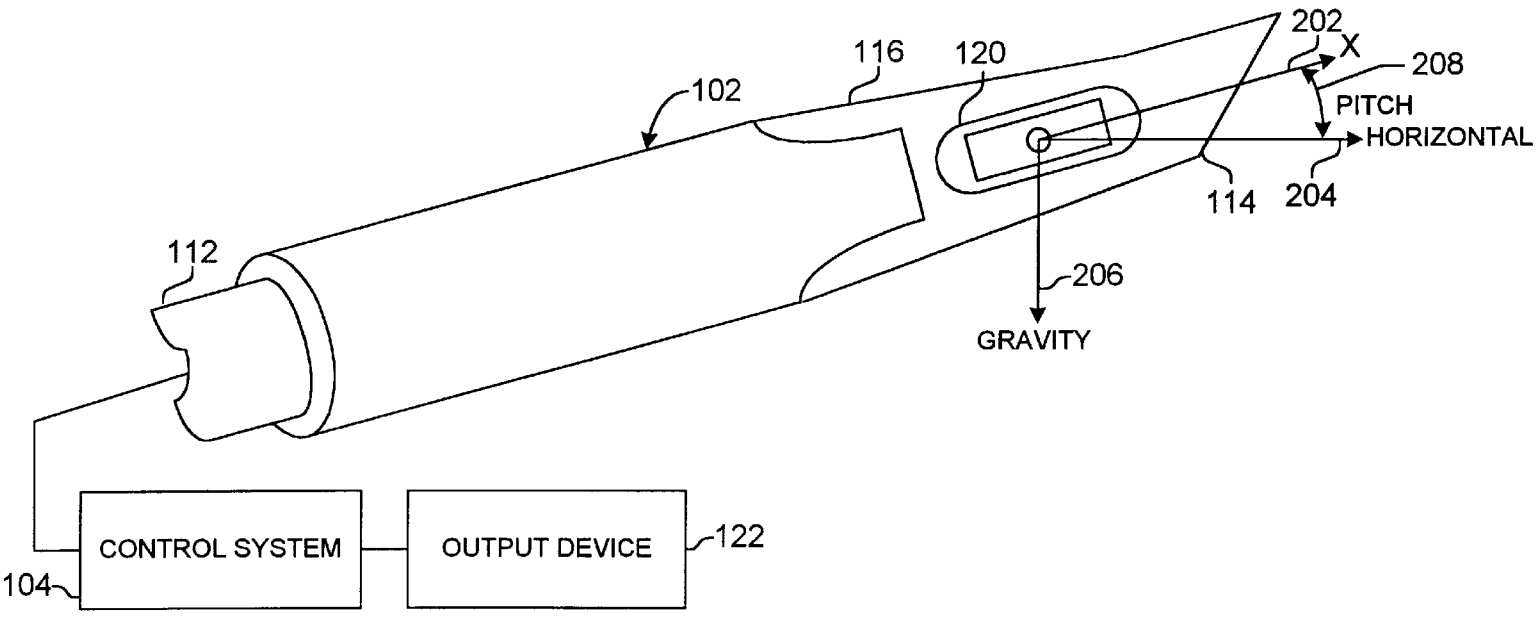
FIG. 3 is a block diagram of the boring tool of FIG. 2 at a pitch angle relative to a gravity vector and a horizontal plane.

In FIG. 3, the boring tool 102 is shown with its axis 202 positioned at an angle to the horizontal plane 204 as if the boring tool were ascending. As the boring tool 102 ascends, the tool axis 202 is no longer in line with the horizontal plane 204 and is no longer perpendicular to the gravity vector 206. The pitch angle 208 shown in FIG. 2 is roughly 15 degrees.

The guidance module 120 determines the pitch angle over a desired range of from plus-to-minus forty-five degrees from the horizontal plane 204, which corresponds to from plus-to-minus one hundred percent grade. Percentage grade is the slope of the inclination or declination of the boring tool 102. Resolution of the pitch angle is better than one-half of a degree.

Figure 4:
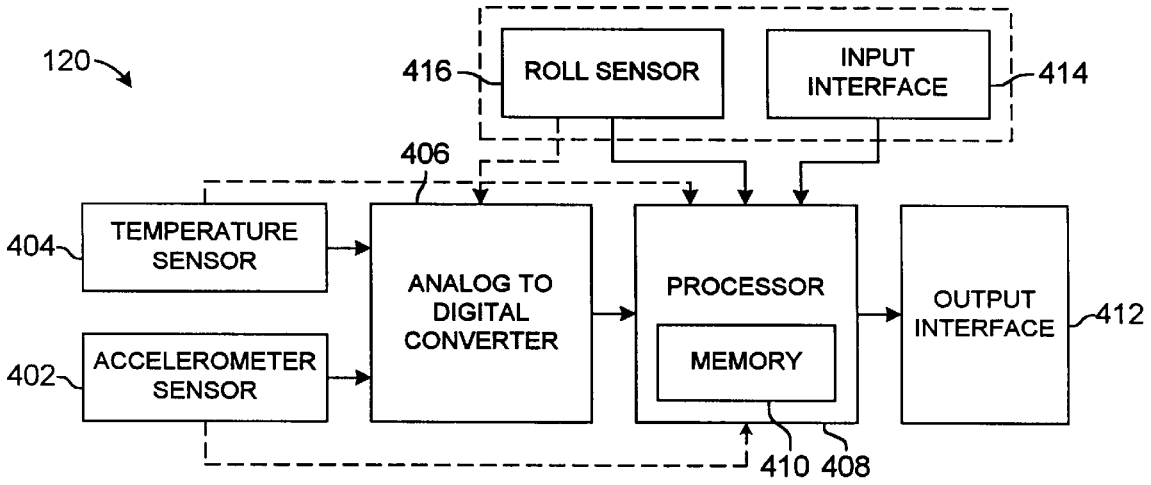
FIG. 4 is a block diagram of the sensor system of the present invention.

Turning to FIG. 4, a guidance module constructed in accordance with the present invention will be described. The guidance module 120 is compact and small in size. In addition, it consumes little power. The guidance module 120 uses a sampling technique in which a plurality of samples of data readings are measured within a window of time. Because the module 120 is capable of sampling data at half-cycle intervals, the power may be turned off every half-cycle when the data is not sampled, thus reducing power consumption.

The guidance module 120 may contain one or more sensors and a processor. Preferably, the module 120 comprises an accelerometer sensor 402 that takes data samples of the pitch angle of the boring tool 102. (See FIG. 3.) The module 120 comprises a temperature sensor 404 to sense the temperature near the accelerometer sensor 402. Still further, an analog-to-digital converter 406 converts analog signals from the accelerometer sensor 402 or analog signals from the temperature sensor 404 to digital signals.

The guidance module 120 also has a processor 408 to process the information from the sensors 402 and 404 and to determine the pitch angle 208 (FIG. 3). The processor 408 may include a memory 410 to store programming and data. Also included in the module 120 is an output interface 412 that allows the processor 408 to transmit a signal containing the pitch angle to output device 122 of the boring assembly 100. (See FIGS. 1–3.)

Referring still to FIG. 4, the guidance module 120 may include an input interface 414 to allow an operator to load programs or information to the processor 408 or to run various programs in the processor. A roll sensor 416 can also be included to determine the rotation or roll angle of the boring tool 102.

The accelerometer sensor 402 senses pitch data samples of a pitch angle and transmits the results of the pitch data samples in a pitch signal to the processor 408. The pitch signal generally is transmitted first as an analog signal to the analog-to-digital converter 406 to be converted to a digital format before being sent to the processor 408. However, in some cases, the accelerometer sensor 402 is capable of transmitting the pitch signal directly to the processor 408 in the digital format.

Preferably, the accelerometer sensor 402 has a single sensitive axis. The sensitive axis is the axis which senses the change in the pitch angle. The sensitive axis of the accelerometer sensor 402 is aligned parallel to, and preferably coaxial with, the tool axis 202. The sensitive axis is positioned orthogonal to the gravity vector 206 when the accelerometer sensor and the boring tool 102 are horizontal. This orientation provides the accelerometer sensor 402 with the most sensitivity to sense the pitch angle near the horizontal plane 204, and thereby provides high resolution data samples near the horizontal plane. This orientation also provides the accelerometer sensor 402 with the most insensitivity to the roll angle because the sensitive axis is parallel to the tool axis 202. This insensitivity to the roll angle is important where the boring tool 102 rotates in normal operation and the pitch angle must be accurate at any roll angle.

In some cases, the accelerometer sensor 402 can be aligned parallel to the tool axis 202. In such a configuration, the accelerometer sensor 402 output is proportional to the pitch angle. In such a parallel configuration, a roll sensor 416 can be used to provide error correction for any roll angle that might inject error into the pitch angle determination.

The accelerometer sensor 402 operates at a direct current ()C) level which allows the accelerometer sensor to determine a static acceleration force, such as the gravity vector 206. (See FIG. 3.) Thus, the gravity vector 206 is considered an acceleration. When the accelerometer sensor 402 is used in such a manner, the gravity vector 206 is used to define the horizontal plane 204 (FIG. 3), and the pitch angle can be determined as the acceleration force between the gravity vector and the horizontal plane 204.

The accelerometer sensor 402 is configured to provide a unipolar output. For a unipolar output, a negative number is not transmitted for the pitch vector. A scaled range is set for the maximum gravity (g), the minimum g, and the zero g. This scaled range can be chosen and set by an operator during manufacture of the guidance module 120. For example, the scaled range may be set for 1 volt (V) at maximum g, 1.8V at zero g, and 2.6V at minimum g. Alternatively, the scaled range can be set at any other range such as 3.5V at maximum g, 2.5V at zero g, and 1.5V for minimum g. By setting the scaled factor, an operator can complete programming for processing options in the processor 408.

The accelerometer sensor 402 is rugged and able to withstand hundreds of gravity forces, wherein the force of gravity, and one g, is 32 feet per second per second ($ft/s^2$) (9.8 meters per second per second ($m/S^2$)). However, the accelerometer sensor 402 is sensitive enough that is has a resolution to a milli-g value. The resolution of the accelerometer sensor 402 means the lowest g level that the accelerometer is capable of measuring.

The accelerometer sensor 402 is sensitive to both positive and negative acceleration forces along a single accelerometer sensitive axis. Moreover, the accelerometer sensor 402 is minimally sensitive to acceleration forces occurring in planes that are normal to the sensitive axis. One commercially available accelerometer sensor which is suitable for use with the present invention is the model ADXL05 accelerometer manufactured by Analog Devices, Inc. (Norwood, Mass.).

Figure 5:
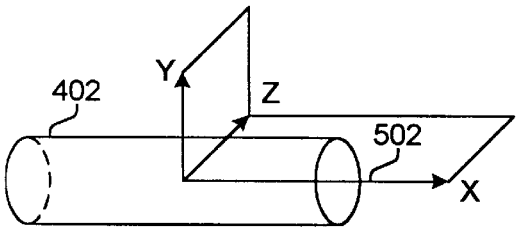
FIG. 5 is a relational view of planes transverse to the sensitive axis of an accelerometer sensor.

Referring now to FIG. 5, the accelerometer sensor 402 is shown therein positioned so that its sensitive axis 502 is coaxial with the tool axis 202. (See FIG. 3.) The sensitive axis 502 is designated as the "X" axis. Transverse acceleration forces may operate on the accelerometer sensor 402. These transverse forces are shown as operating at the "Y" and "Z" axes, and would operate on the Y-Z and Z-X planes, respectively.

Figure 6:
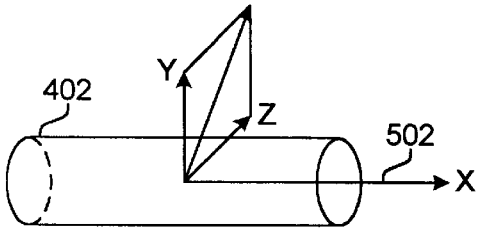
FIG. 6 is a relational view of planes transverse to the sensitive axis of an accelerometer sensor.

FIG. 6 illustrates transverse forces on the Y and Z axes and the Y-Z plane. As the boring tool 102 FIG. 3) rotates, the forces on the Y and Z axes are not inseparable and have a minor effect on the forces on the X axis. The pitch angle is determined from the forces applied along the X axis.

Figure 7:
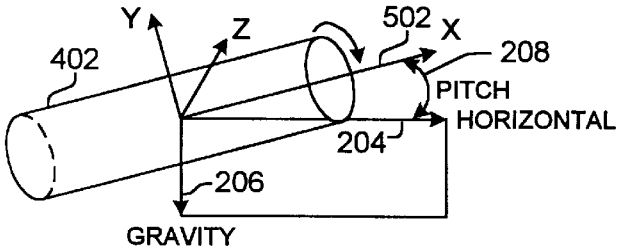
FIG. 7 is a relational view of a gravity vector and a horizontal plane in relation to a pitch angle.

FIG. 7 illustrates the accelerometer sensor 402 inclined above the horizontal plane 502. As the accelerometer sensor 402 ascends to an inclined pitch angle, and as the boring tool continues to rotate, the sensitive axis 502 continues to lie in a plane with the horizontal plane 204 and the gravity vector 206. In addition, when the sensitive axis 502 is aligned with the tool axis 202, rotation about the sensitive axis 502 does not change the angle to the horizontal plane 204. Consequently, the output of the accelerometer sensor 402 is not sensitive to roll. In this way, the pitch angle 208 always can be determined.

Referring again to FIG. 4, the temperature sensor 404 is used to provide compensation for thermal drift of the accelerometer sensor 402. Thermal drift can cause an error of up to several hundred millivolts (mV) over an operating temperature range from 32 to 176 degrees Fahrenheit (°F.) (0–80 degrees Celsius (°C.)).

The temperature sensor 404 senses the temperature associated with the accelerometer sensor 402 and transmits the results of the temperature readings in a temperature signal. The temperature sensor 404 provides an output of ten mV/°F. (18 mV/°C.) as a temperature signal.

Because the accelerometer sensor 402 readings may vary at different temperatures, the temperature signal from the temperature sensor 404 is used by the processor 408 to determine a temperature offset to compensate for such variations and thereby correct for error in the determination of the pitch angle. Generally, the temperature signal is an analog signal that is transmitted to the analog-to-digital converter 406 to be converted to a digital format before being transmitted to the processor 408. However, in some instances, the temperature signal may be transmitted directly to the processor 408 in a digital format.

The analog-to-digital converter 406 converts the signals to a digital format and transmits the signals to the processor 408. In most instances, each sensor 402 and 404 transmits the results of the sensor readings to the analog-to-digital converter 406 in an analog format. The preferred analog-to-digital converter 406 is a twelve bit multi-channel converter. It has a 4.096 volt reference. With $2^{12}$ bits (4096 bits), a resolution of 1 mV per bit is obtained.

Other methods and devices, however, may be used to convert the signals to a digital format, including a sigma delta pulse density stream. When a sigma delta pulse density stream method is used, the digital resolution is proportional to the period over which the pulses are accumulated and to the pulse frequency. The sigma delta pulse density stream method provides an acceleration measure with a low bandwidth and a low update rate wherein pulses are proportional to acceleration and are accumulated over a time interval to get an acceleration representing the pitch data samples.

The processor 408 contains the programming and memory required to use the raw data from the accelerometer sensor 402, the temperature sensor 404, the roll sensor 416, and the input interface 414 and to determine the pitch angle. The processor 408 controls the acquisition of data for calibration of the guidance module 120 and for the operation routines of the system. The processor 408 processes the data, performs necessary calculations and corrections, and transmits the results to the output device 122. (See FIGS. 1–3.) The processor 408 has an associated memory 410 that stores data and programming.

The processor 408 applies filtering to the pitch signals received from the accelerometer 402. Filtering, such as lowpass filtering, is used so that the pitch angle can be measured effectively while the boring tool 102 is rotating. The filtering reduces vibration noise and other electrical noise and provides a clean signal. Vibration noise is generally at a higher frequency than the pitch angle data. Pitch angle data is considered low bandwidth because the frequency response does not change quickly. This is due to the limitations of the rate at which the pitch angle of the boring tool 102 may change in use. Because the bandwidth of the pitch angle data is on the order of hertz, as opposed to electrical noise which is on the order of kilohertz, a lowpass bandwidth filter may be applied to the pitch angle data contained in the pitch signal that is transmitted from the accelerometer sensor 402.

The lowpass bandwidth filter can be either an analog filter or a digital filter. For example, digital filters may be finite impulse response (FIR) filters that use a weighted average of samples or infinite impulse response (IIR) filters that use continuous averaging. In addition, a simple average method may be used to digitally filter the data. The simple average reduces the noise by the square root of the number of samples taken. The simple average is the preferred lowpass bandwidth filtering method.

The processor 408 calibrates the accelerometer sensor 402 to determine a compensating gain factor. A compensating gain factor is an adjustment for the sensitivity of the accelerometer sensor 402 when it is not in motion or being acted upon by the gravity vector 206. (See FIG. 7.) This compensating gain factor corrects for a sensitivity error in the determination of the pitch angle to produce a uniform sensitivity for multiple devices. The processor 408 compensates for the error.

The processor 408 also uses the temperature sensor 404 to determine a temperature offset. The temperature offset is the offset for the DC value output by the accelerometer sensor 402 in the zero gravity position at a specified temperature when the accelerometer sensor is not at a zero pitch angle.

In addition, the processor 408 may be configured to use the roll sensor 416 to determine a roll angle offset. The roll angle offset is an offset introduced as a DC component value output by the accelerometer sensor 402 when the accelerometer sensor is at a zero pitch angle and is rotating.

The processor 408 uses the data that it receives to compute the pitch angle. The processor 408 averages the pitch angle data, adjusts the pitch angle data for the offsets, and computes the pitch angle. The processor 408 then outputs the pitch angle in an output signal.

The output interface 412 transmits the output signal from the processor 408 to the control assembly 104 or to the output device 122. The output interface 412 is preferably configured to use a serial communication link from the processor 408 to modulate a radio frequency (RF) circuit (not shown) and to transmit the pitch angle as an RF signal. Alternately, the output interface 412 can be configured to transmit the pitch angle through a different wireless communication or over a transmission line. It will be appreciated that a parallel communication link can also be used.

Referring still to FIG. 4, the input interface 414 is an optional interface that allows an external computer (not shown) or operator to communicate with the processor 408. By using the input interface 414, an external source, such as the external computer, can give processor input signals, such as commands, to the processor 408. The external source can place the processor in different modes of operation, load programming to the processor, or process data.

The roll sensor 416 is an optional sensor that senses the roll angle associated with the accelerometer sensor 402 and transmits the results of the roll angle readings in a roll sensor signal to the processor 408. Any angle of deviation between the axis 202 of the boring tool 102 (FIG. 3) and the sensitive axis 502 of the accelerometer 402 (FIG. 7) will scribe a cone of error around the sensitive axis 502 when rotated. Because the accelerometer sensor 402 readings may vary at different roll angles, the roll angle reading from the roll sensor 416 is used by the processor 408 to determine a roll offset to compensate for such variations and thereby correct for roll angle dependent pitch angle error. The roll sensor 416 can be, for example, a mercury sensor.

The roll sensor 416 is used, for example, when the percentage of error in the pitch angle determination is to be less than two percent. Generally, mechanical alignment can be completed so that the percent error is about two percent, although greater effectiveness may be obtained using electrical alignment methods. Thus, there is a tradeoff between low percentage error in the pitch angle determination using a roll sensor and alignment in manufacturing.

Generally, the roll sensor 416 transmits the roll angle readings directly to the processor 408 in a digital format. However, in some instances, the roll sensor 416 may transmit an analog signal to the analog-to-digital converter 406 to be converted to a digital format before it is transmitted to the processor 410.

Figure 8:
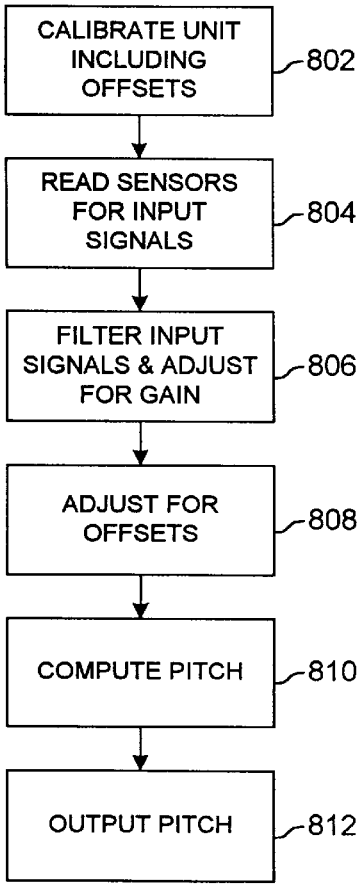
FIG. 8 is a flowchart of a pitch angle algorithm.

A high level method for using the guidance module 120 of FIG. 4 is illustrated in FIG. 8. Initially, the system is calibrated for the compensating gain factor of the accelerometer sensor 402 and for the temperature offset (step 802). Next, the accelerometer sensor 402 and the temperature sensor 404 each take data samples and transmit the results to the processor 408 (step 804). If a roll sensor 416 is included in the guidance module 120, the roll sensor also takes data samples and transmits the results to the processor. The processor 408 filters the pitch angle data samples from the accelerometer sensor 402 and adjusts the filtered accelerometer data samples with the compensating gain factor (step 806).

The processor 408 uses the data sample from the temperature sensor 404 to get a temperature offset and adjusts the pitch angle data with the temperature offset (step 808). At the same step in the process, if a roll sensor 416 is used, the data samples from the roll sensor 416 are used by the processor 408 to get a roll angle offset that can be used to adjust the pitch angle data. The processor then computes the pitch angle (step 810). The computed pitch angle is then output (step 812) through the output interface 412 to the output device 122. (See FIG. 1.)

The guidance module 120 uses a temperature calibration routine to compensate for pitch angle error associated with temperature. Such error occurs because the accelerometer sensor 402 readings at a single pitch angle can differ at different temperatures.

Figure 9:
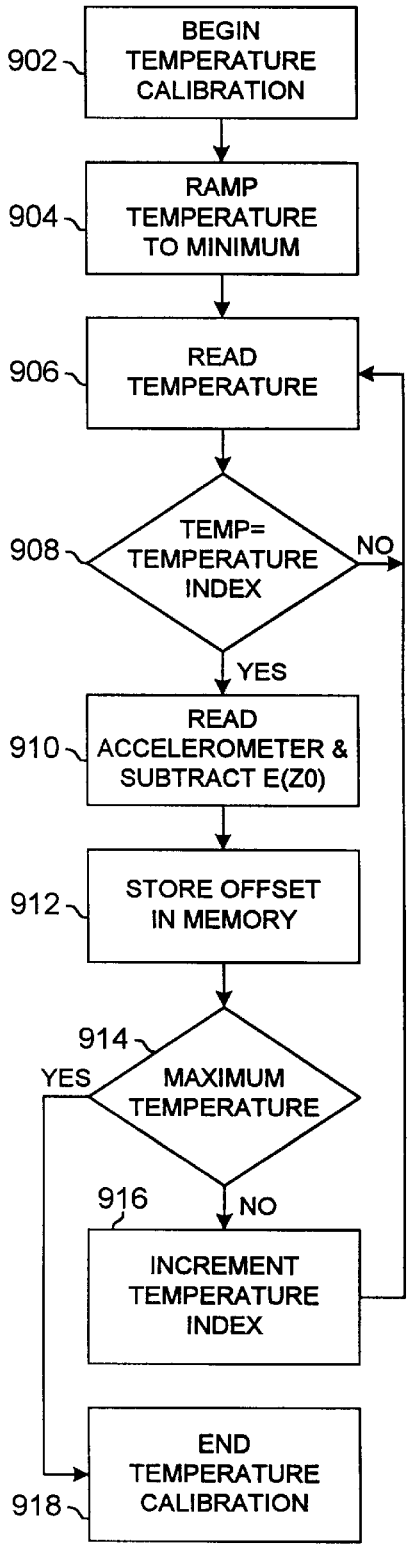
FIG. 9 is a flowchart of a temperature calibration method.

The temperature calibration method is illustrated in FIG. 9. The temperature calibration is typically performed in a heating/cooling unit such as an environmental oven. The guidance module 120 is mounted in the environmental oven at a neutral input position, such as the zero gravity level, for calibration.

The processor 408 enters the temperature calibration mode (step 902), and the temperature in the environmental chamber is lowered to a minimum temperature requirement for the guidance module 120 (step 904). In the preferred embodiment, the minimum temperature requirement is 5° F. (−15° C.).

The temperature sensor 404 reads the temperature and transmits the temperature to the processor 408 (step 906). When the processor 408 detects the minimum temperature, it begins to assemble a temperature calibration table that is stored in memory 410.

The temperature in environmental oven is increased from the minimum level to a maximum level. While the temperature is being increased, the temperature sensor 404 continues to transmit the temperature to the processor 408. The processor 408 is configured to read the accelerometer sensor 402 at predetermined temperature indexes. For example, the temperature index can be predetermined for every 16° F. (8.9° C.) in a first embodiment, or for every 6.4° F. (3.56° C.) for a second embodiment.

If a temperature index has not been reached (step 908), then the temperature sensor 404 continues to transmit the temperatures and the processor 408 continues to read the temperatures (step 906) until a temperature index is reached.

Once a temperature index is reached, the processor 408 reads the signal from the accelerometer sensor 402 and subtracts the zero offset E(Z0) from the reading to determine the temperature offset for the temperature index (step 910). The zero offset E(Z0) is equal to the quantity of the maximum gravity value plus the minimum gravity value divided by two [E(Z0)=(maximum g+minimum g)/2]. The value for the temperature offset is stored in memory 410 at the temperature index (step 912).

If the maximum temperature has not been reached (step 914), then the processor 408 increments the temperature index for which the next accelerometer reading will be taken (step 916). The temperature in the environmental oven is increased, and the processor 408 continues to read the temperatures transmitted by the temperature sensor 404 (step 906) until the next temperature index has been reached (step 908). If the maximum temperature has been reached (step 914), then the temperature calibration is complete (step 918). This process continues until the maximum temperature has been reached.

By calibrating the accelerometer sensor 402 by temperature in this manner, a table is created that is indexed by temperature. Within the range of temperatures, wherein the range is specified between two temperature indexes, the table contains a temperature offset that was saved in the table. This temperature offset is the DC value output by the accelerometer sensor 402 in the zero gravity position within the specified temperature range. Thus, as the boring tool 102 is operating, the processor 408 can look up the value of the temperature offset by the temperature index. The temperature offset can then be subtracted so that it does not introduce error into the determination of the pitch angle.

The size of the table is dependent on the resolution of the temperature sensor 404 and the amount of temperature sensitivity in the accelerometer sensor 402. The table size may be reduced by using fewer table indexed entries and extrapolating data between table entries.

Accuracy of the pitch angle is directly influenced by the alignment accuracy of the sensitive axis 502 of the accelerometer sensor 402 with the longitudinal axis of the boring tool 102 (see FIG. 5). A roll compensation routine can be used to enhance the pitch angle accuracy. Therefore, the guidance module 120 can optionally use a roll angle calibration routine to compensate for pitch angle error associated with different angles of roll. Such error occurs because the accelerometer sensor 402 readings at a single pitch angle can differ at different roll angles.

Figure 10:
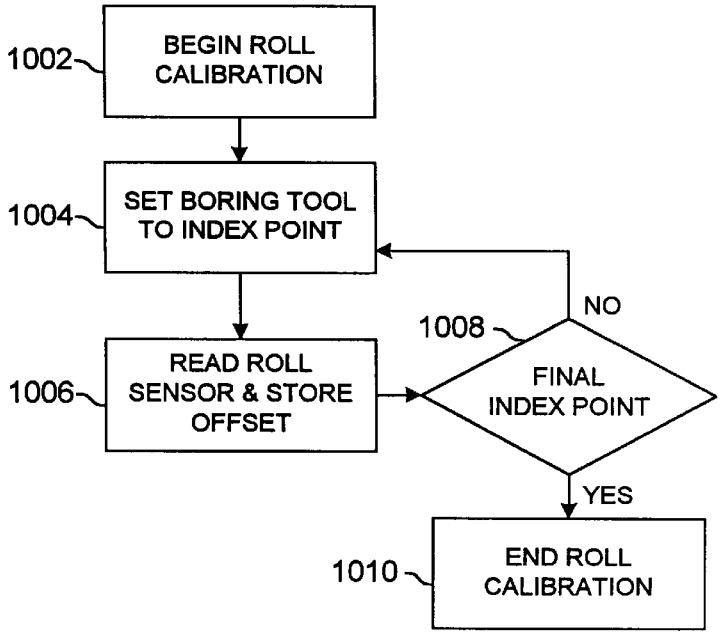
FIG. 10 is a flowchart of a roll angle calibration method.

The roll angle calibration is illustrated in FIG. 10. The roll angle calibration is used to determine a roll angle offset for different rotation angles. The roll angle calibration is performed while the longitudinal axis of the boring tool 102 FIG. 3) is in a neutral input position, such as the zero pitch for the boring tool 102. In this position, the boring tool 102 is oriented horizontally in the zero gravity position.

Preferably, roll calibration is the final step to set the zero alignment of the guidance module 120 in the boring tool 102. Because final assembly may cause shifts in the orientation of the guidance module 120 in the boring tool 102, the roll calibration is used to orient the guidance module so that the zero output of the boring tool is at the horizontal position.

The roll calibration begins (step 1002), and the boring tool 102 is set to a first index point (step 1004). Preferably, there are four index points, each ninety degrees apart. With reference to degree coordinates, the first index point corresponds to a position at zero degrees, the second at 90 degrees, the third at 180 degrees, and the fourth at 270 degrees. However, it will be appreciated that greater or fewer index points may be used, and other coordinate references may be used.

At the index point, the roll sensor 416 (FIG. 4) transmits a signal containing the roll angle to the processor 408. The processor 408 computes the roll angle offset as being equal to the zero offset E(Z0) minus the output from the roll sensor 416 [roll angle offset=E(Z0)−roll sensor output]. The zero offset E(Z0) is equal to the quantity of the maximum gravity value plus the minimum gravity value divided by two [E(Z0)=(maximum g+minimum g)/2]. The processor 408 uses the index point to store the roll angle offset in the memory 410 at the index point (step 1006). Then, it is determined if the final index point has been reached (step 1008). If the final index point has been reached, the roll calibration is ended (step 1010). If the final index point has not been reached, the boring tool 102 is set to the next index point (step 1004), and the process continues until the final index point has been reached.

By calibrating the boring tool 102 by roll angle in this manner, a table is created that is indexed by the degree coordinate references. Within the range of references, wherein the range is specified between two roll angle indexes, the table contains a roll angle offset that was saved to the table from the roll sensor 416.

In accordance with a first embodiment of the method of the present invention, the guidance module 120 of FIG. 4 can be operated in four modes: a gain calibration mode, a temperature calibration mode, a roll calibration mode, and a normal run mode. Calibration can be completed in either the processor 408 or in an external computer.

Operation of the guidance module 120 commences when a signal is transmitted through the input interface 414 to the processor 408 to instruct the processor in which mode the processor is to operate. The temperature calibration and the roll angle calibration of the first embodiment are consistent with those described in FIGS. 9 and 10, respectively. However, the gain calibration mode and the normal run mode for the first embodiment are unique to the first embodiment.

Figure 11:
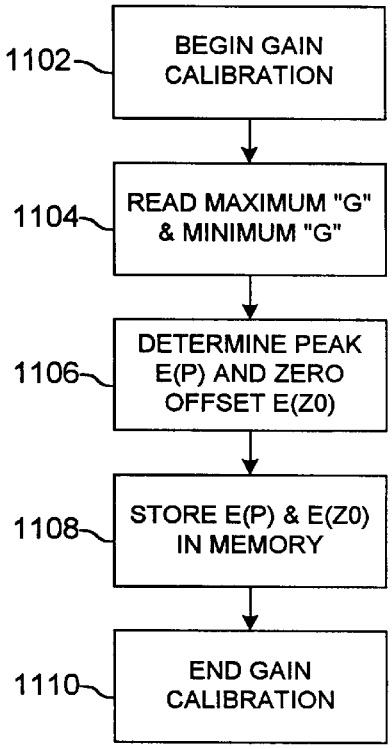
FIG. 11 is a flowchart of a first gain calibration method.

A preferred gain calibration mode is illustrated in FIG. 11. The processor 408 enters the gain calibration mode (step 1102) when a signal is transmitted from the input interface 414 requesting the gain calibration. Gain calibration is typically performed during manufacture of the boring tool 102 (FIG. 3). When calibrating the gain, the accelerometer sensor 402 obtains data samples in a maximum input position, such as a maximum gravity position, and in a minimum input position, such as a minimum gravity position (step 1104). The maximum gravity position is the position of the accelerometer sensor 402 when the sensitive axis is directed opposite to the gravity vector 206 so that the accelerometer sensor 402 produces the most positive output. The minimum gravity position is the position of the accelerometer sensor 402 when the sensitive axis is directed along the gravity vector 206 so that the accelerometer sensor 402 produces the most negative output.

The processor 408 then uses the maximum and minimum gravity data samples to compute the peak value E(P) and the zero offset E(Z0) of the gain (step 1106). The peak value E(P) is equal to the quantity of the maximum gravity value minus the minimum gravity value divided by two [E(P)=(maximum g−minimum g)/2]. The zero offset E(Z0) is equal to the quantity of the maximum gravity value plus the minimum gravity value divided by two [E(Z0)=(maximum g+minimum g)/2]. The peak value E(P) and the zero offset E(Z0) are stored in memory 410 as the compensating gain factor and the compensating offset, respectively, for later retrieval (step 1108), and the gain calibration is complete (step 1110).

Figure 12:
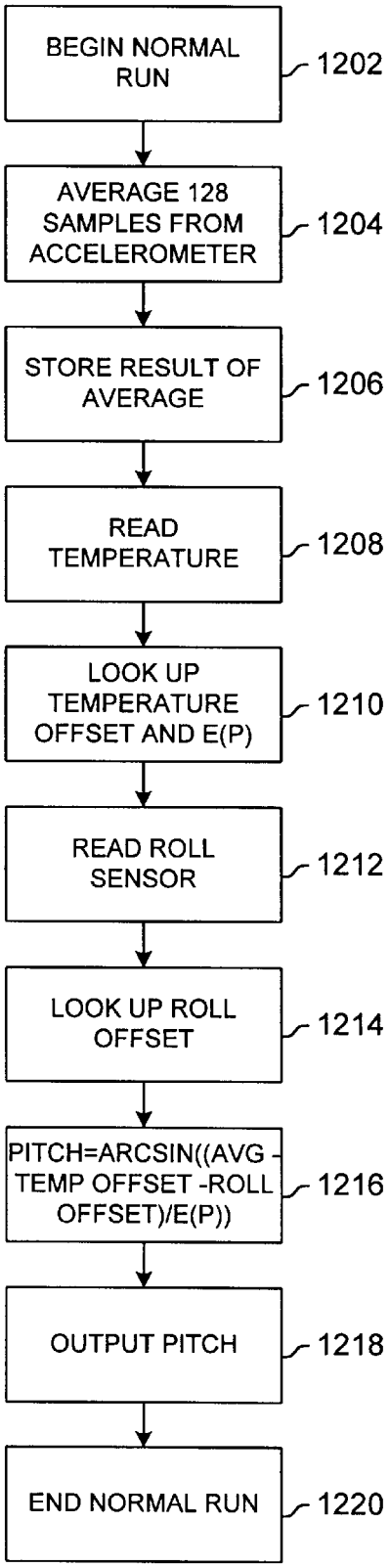
FIG. 12 is a flowchart of a first embodiment of a method of determining pitch using a gain factor, temperature offset, and a roll offset.

The normal operation method of the first embodiment is illustrated in FIG. 12. The processor 408 enters the normal run mode (step 1202) when a signal is transmitted from the input interface 414 requesting the normal run operation. This mode of operation is used when the boring tool 102 is in use and the pitch angle is to be determined.

When the normal run mode is entered (step 1202), the processor 408 accepts 128 data samples from the accelerometer sensor 402 over a fifty milli-second period and averages the samples using a simple average method (step 1204). In this simple average, the processor 408 sums all of the data samples and divides the sum by the number of samples taken to get an average result. The average result is stored in memory 410 (step 1206).

The processor 408 next accepts the temperature reading from the temperature sensor 404 (step 1208). The processor 408 uses the temperature as an index to look up the temperature offset from the temperature calibration table, and the processor retrieves the compensating gain factor E(P) from memory 410 (step 1210).

The roll sensor is read (step 1212), and the corresponding roll angle offset is retrieved from memory (step 1214). The processor 408 then calculates the pitch angle (step 1216) wherein the pitch angle is equal to the arcsin of the quantity of the average result of the accelerometer samples minus the temperature offset and minus the roll offset divided by the compensating gain factor E(P) [pitch angle=arcsin((average−temperature offset−roll offset)/E(P))].

The pitch angle is output (step 1218) to the output device 122. (See FIG. 1.) The normal run mode is complete (step 1220). This sequence is repeated until power is removed from the guidance module 120.

Figure 13:
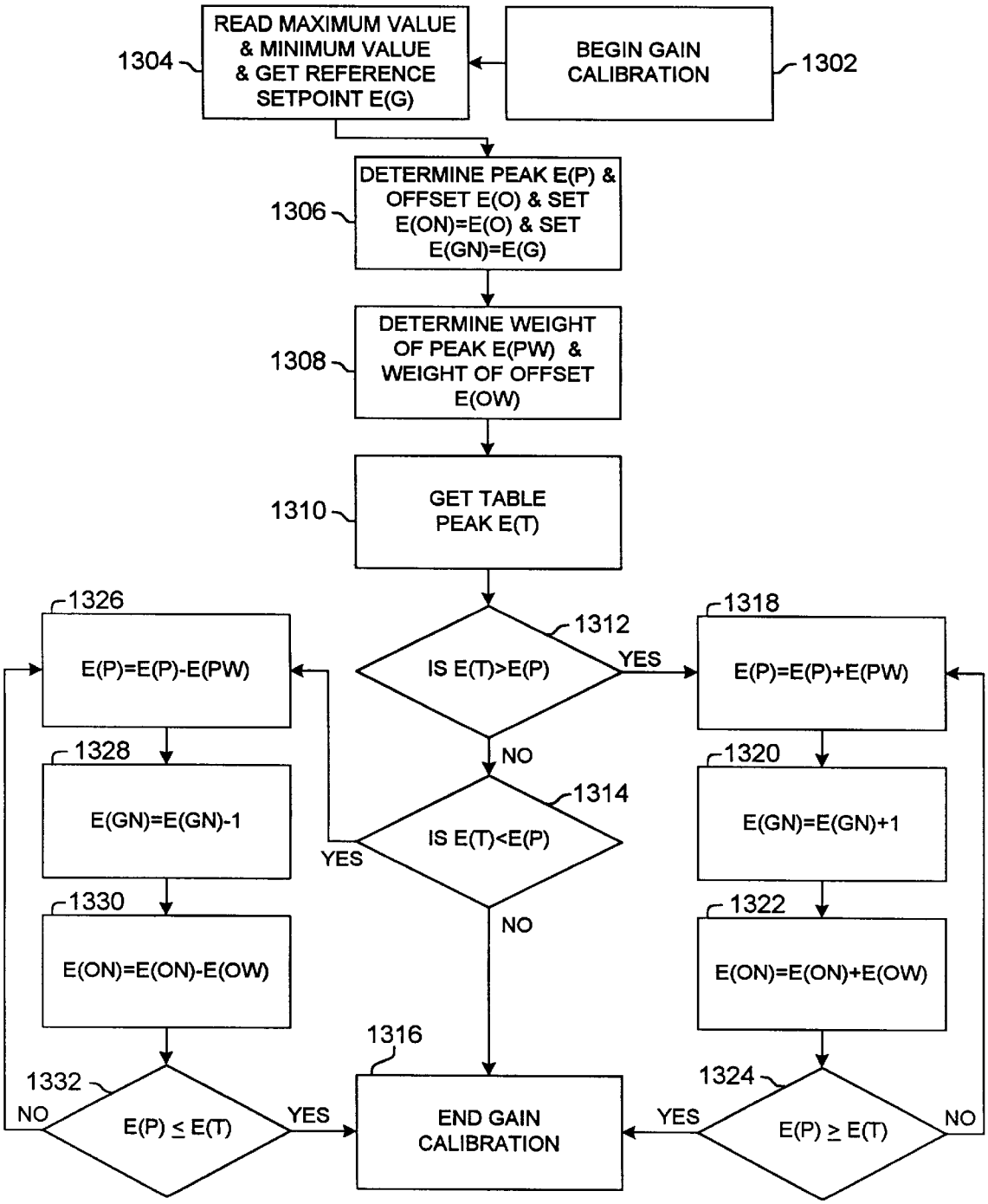
FIG. 13 is a flowchart of a gain calibration method for use with an input device.

FIG. 13 illustrates a preferred method of calibrating for gain when reading values from a sensor or other device at a processor, such as the processor 408 of FIG. 4. Data samples which are non-uniform are gain-compensated without using variable or test-selected data. The method uses a local average to effect a gain change.

The gain is the number of data samples, also known as steps, divided by a gain reference setpoint which is constant. For example, the gain reference setpoint can be set at 1024. Therefore, gain (G) is equal to the number of samples divided by 1024 (G=n/1024). If a large number of samples is chosen, such as 1024 samples, the number of samples may be increased or decreased to control the gain provided the divisor is maintained at a constant gain reference setpoint. For example, for a gain of one, n=1024 where the gain reference setpoint is also set to 1024.

When computing the gain, no division or multiplication need occur if the gain reference setpoint is set at 1024. Because the processor 408 uses twenty-four bits for computations, the binary numbers can be shifted to the right by ten bits. This method essentially divides any number by 1024 without computing a mathematical division in the processor 408, which saves valuable processor memory.

The gain step resolution is approximately 1/gain reference setpoint or approximately one-tenth of a percent gain change per data point sum change. The gain change range is typically in the order of plus or minus ten percent.

The output from the simple average is gain compensated and does not require gain adjustment processing after the data is collected. The results are trimmed to the scale factor of the input device and to a constant output for a known input device input, such as the value at the maximum input position. This allows use of the table lookup method for translating input device data to output data. By adjusting the input device output to match the table constants, the table can be non-linear and thereby provide a higher resolution at the specified input positions.

Gain calibration is typically performed when the input device to be calibrated is manufactured. After gain calibration begins (1302), the input device obtains data samples in the maximum input position to get a maximum value and a minimum input position to get a minimum value (step 1304) while the gain is equal to one.

In addition, a gain reference setpoint E(G) is obtained from memory (step 1304). The gain reference setpoint is the number of steps that have been determined to provide a gain of one. Preferably, the gain reference setpoint is set at 1024.

Next, the sample peak E(P) and zero offset E(O) are determined, and the compensating gain factor E(ON) and the compensating gain setpoint E(GN) are set to the zero offset and the gain reference setpoint, respectively (step 1306). The sample peak E(P) is determined by dividing by two the quantity of the maximum value minus the minimum value [E(P)=(maximum value−minimum value)/2]. The zero offset E(O) is determined by dividing by two the quantity of the maximum value plus the minimum value [E(O)=(maximum value+minimum value)/2].

Then, the weighted sample peak E(PW) and the weighted offset E(OW) are determined (step 1308). The weighted sample peak E(PW) is determined by dividing the sample peak by the gain reference setpoint [E(PW)=E(P)/E(G)]. The weighted offset E(OW) is determined by dividing the zero offset by the gain reference setpoint [E(OW)=E(O)/E(G)].

A reference peak value, such as a table peak E(T) value, is retrieved from memory (step 1310). The table peak value is the table maximum value that is a projected reading of the input device at the maximum input position. The table peak is hard-coded in the software as the last entry in the table.

The table peak is compared to the sample peak value (step 1312). If the table peak is not greater than the sample peak (step 1312) and the table peak is not lower than the sample peak (step 1314), then the table peak is equal to the sample peak and the gain calibration is ended (step 1316).

If, however, the table peak is greater than the sample peak (step 1312), then the number of data points that are summed is increased. The sample peak value is increased by the value of the weighted sample peak (step 1318). The number of sample points for the compensating gain setpoint E(GN) is increased by a gain adjustment value. In the method of FIG. 13, the gain adjustment value is equal to one (step 1320). The compensating gain factor E(ON) is increased by the value of the weighted offset (step 1322). Then, if the current value of the sample peak is greater than or equal to the value of the table peak (step 1324), the gain compensation is ended (step 1316). However, if the sample peak is not greater than or equal to the table peak (step 1324), then the process returns to step 1318, and an iterative loop is performed until the sample peak is greater than or equal to the table peak.

In this manner, the compensating gain setpoint and the compensating gain factor are iteratively increased. Therefore, no multiplication is required.

In the same way, if the table peak is less than the sample peak (step 1314), then the number of data points that are summed is decreased. The sample peak value is decreased by the value of the weighted sample peak (step 1326). The number of sample points for the compensating gain setpoint E(GN) is decreased by the gain adjustment value which is set to one (step 1328). The compensating gain factor E(ON) is decreased by the value of the weighted offset (step 1330). Then, if the current value of the sample peak is less than or equal to the value of the table peak (step 1332), the gain compensation is ended (step 1316). However, if the sample peak is not less than or equal to the table peak (step 1332), then the process returns to step 1326, and an iterative loop is performed until the sample peak is less than or equal to the table peak.

In this manner, the compensating gain setpoint and the compensating gain factor are iteratively decreased. Therefore, no multiplication is required.

In accordance with a second embodiment of the method of the present invention, the guidance module 120 of FIG. 4 can operate in four modes. The module 120 can operate in a gain calibration mode, a roll calibration mode, a temperature calibration mode, and a normal run mode. Calibration can be completed in either the processor 408 or in an external computer.

The mode of operation is set in the processor 408. The temperature calibration and the roll angle calibration modes are consistent with those described in FIGS. 9 and 10, respectively. However, the gain calibration mode and the normal run mode of the second embodiment are unique to the second embodiment.

Figure 14:
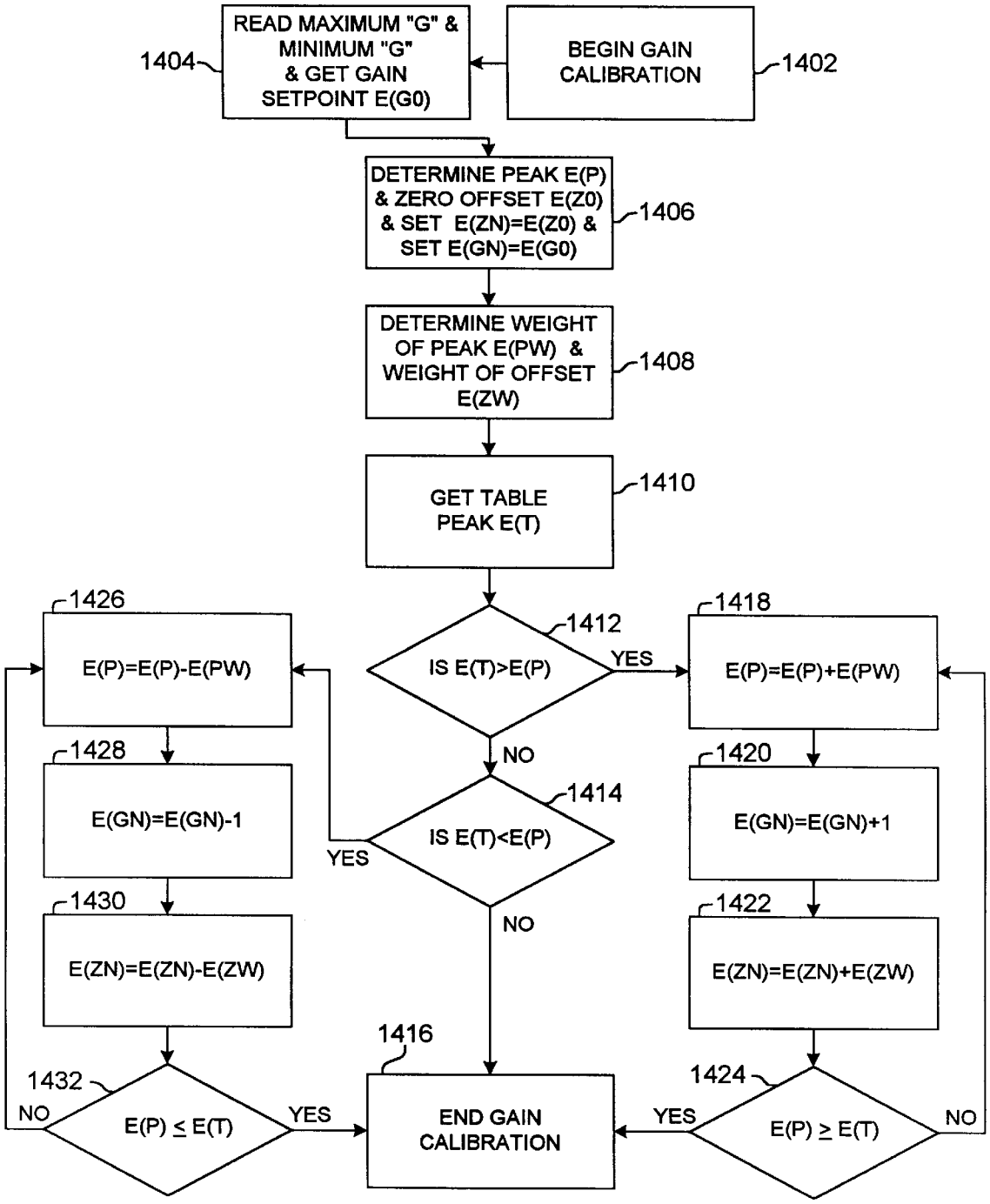
FIG. 14 is a flowchart of a second embodiment of a gain calibration method.

The gain calibration mode of the second embodiment of the method of the present invention is illustrated in FIG. 14. A pitch lookup table is used in the gain calibration mode. The table is pre-calculated and stored in memory. The gain calibration involves adjusting the output of the accelerometer sensor 402 to match the lookup table entry constants.

The lookup table is folded so that a single table has absolute values representative of both positive and negative numbers. The folded table, therefore, requires only half of the memory space required for a full table that has both positive and negative numbers.

The pitch table has a sixteen bit resolution. However, the resolution can be greater or lower. The sixteen bit resolution fits the twelve bit analog-to-digital converter 406. When using the sixteen bit resolution with the twelve bit analog-to-digital converter 406, the bits are shifted to the most significant bit. Therefore, bit numbers four through fifteen contain the twelve bit analog-to-digital converter 406 signal. It will be appreciated, however, that the pitch table can be used when the analog-to-digital converter 406 is not used and the signals are in the digital format.

The pitch table is completed using a selected table maximum value, a selected table minimum value, and a gain reference setpoint. The table maximum value is a projected reading of the accelerometer sensor 402 at a maximum input position, such as the maximum gravity position. The table minimum value is a projected reading of the accelerometer sensor 402 at a neutral input position, such as the zero gravity position. The gain reference setpoint E(G0) can be any number, but it is typically the value of the number of data samples or steps that will be taken. For the present system, the gain reference setpoint is set at 1024.

The pitch table is a non-linear table and thereby provides a higher resolution at the horizontal and a lower resolution near a forty-five degree pitch angle. For example, the pitch table can be projected for every degree from 0–10 degrees, for every two degrees from 10–20 degrees, and for every four degrees from 20–32 degrees, etc.

The table is then completed using the formula theta is equal to the arcsin of the quantity of the compensated data sample divided by the gain reference setpoint [θ=arcsin (compensated data sample/E(G0)], where theta is the pitch angle and the data sample is the accelerometer sensor 402 reading at the maximum input position or the neutral input position. Because the angle theta, the data sample, and the gain reference setpoint are known for the maximum gravity position and for the zero gravity position, and the angle theta and the gain reference setpoint are known for every angle to be projected in the non-linear table, the pitch table can be completed. The table can also be made to output pitch in a percentage grade, which is the preferred output.

FIG. 14 illustrates the gain calibration of the second embodiment. The gain calibration uses a simple averaging method that does not require multiplication. Therefore, it does not limit the processor choices for speed and memory space.

In the simple average, the noise is reduced by the square root of the number of samples. The bandwidth is decreased as the sampling period is increased.

The gain is the number of data samples, also known a s steps, divided by a gain reference setpoint which is constant. For the present system, the gain reference setpoint is set at 1024. Therefore, gain (G) is equal to the number of samples divided by 1024 (G=n/1024). If a large number of samples is chosen, such as 1024 samples, the number of samples may be increased or decreased to control the gain provided that the divisor is maintained at a constant gain reference setpoint. For example, for a gain of one, n=1024 where the gain reference setpoint is also set to 1024.

When computing the gain, no division or multiplication need occur if the gain reference setpoint is set at 1024. Because the processor 408 uses twenty-four bits for pitch computations, the binary numbers can be shifted to the right by ten bits. This method essentially divides any number by 1024 without actually computing a value, which saves valuable processor memory.

The gain step resolution is approximately 1/gain reference setpoint or approximately one-tenth of a percent gain change per sum change. The gain change range is typically in the order of plus or minus ten percent.

The output from the simple average is gain compensated and does not require gain adjustment processing after the data is collected. The results are trimmed to the scale factor of the accelerometer sensor 402 and to a constant output for a known accelerometer sensor 402 input. The known accelerometer sensor 402 input can be a value at a maximum or minimum input positions, such as the value at the maximum or minimum gravity positions.

This allows use of the table lookup method for translating accelerometer sensor 402 data to pitch output. By adjusting the accelerometer sensor 402 output to match the pitch table constants, the pitch table can be non-linear and thereby provide the higher resolution at the horizontal.

Gain calibration is typically performed when the boring tool 102 (FIG. 3) is manufactured. After gain calibrating begins (step 1402), the accelerometer 402 obtains data samples in a maximum input position, such as the maximum gravity position (+1 g), to obtain a maximum g value and at a minimum input position, such as a minimum gravity position (−1 g), to obtain a minimum g value (step 1404), while the gain is equal to one. The maximum gravity position occurs with the sensitive axis 502 (FIG. 7) of the accelerometer sensor 402 pointing straight up. The minimum gravity position occurs with the sensitive axis 502 of the accelerometer sensor 402 pointing straight down. The accelerometer sensor 402 measures the gravity and has maximum and minimum outputs at the maximum gravity position and minimum gravity position, respectively.

In addition, the gain reference setpoint E(G0) is obtained from memory (step 1404). The gain reference setpoint is the number of steps that have been determined to provide a gain of one. Preferably, the gain reference setpoint is set at 1024.

Next, the sample peak E(P) and zero offset E(Z0) are determined, and the compensating gain factor E(ZN) and the compensating gain setpoint E(GN) are set to the zero offset and the gain reference setpoint, respectively (step 1406). The sample peak E(P) is determined by dividing by two the quantity of the maximum gravity value minus the minimum gravity value [E(P)=(maximum g−minimum g)/2]. The zero offset E(Z0) is determined by dividing by two the quantity of the maximum gravity value plus the minimum gravity value [E(Z0)=(maximum g+minimum g)/2].

Then, a sample peak adjustment value, such as a weighted sample peak E(PW), and an offset adjustment value, such as a weighted offset value E(ZW), are determined (step 1408). The weighted sample peak E(PW) is determined by dividing the sample peak by the gain reference setpoint [E(PW)=E(P)/E(G0)]. The weighted offset E(ZW) is determined by dividing the zero offset by the gain reference setpoint [E(ZW)=E(Z0)/E(G0)].

A reference peak value, such as a table peak E(T) value, is retrieved from memory (step 1410). The table peak value is the table maximum value that is a projected reading of the accelerometer sensor 402 at the maximum input position. The table peak is hard-coded in the software as the last entry in the pitch table. Therefore, the table peak is always the same value.

The table peak is compared to the sample peak (step 1412). If the table peak is not greater than the sample peak (step 1412) and the table peak is not lower than the sample peak (step 1414), then the table peak is equal to the sample peak and the gain calibration is ended (step 1416).

If however, the table peak is greater than the sample peak (step 1412), then the number of data points that are summed is increased. The sample peak value is increased by the value of the weighted sample peak E(PW) (step 1418). The number of sample points for the compensating gain setpoint E(GN) is increased by a gain adjustment value (step 1420). In the present method, the gain adjustment value is set to one. The compensating gain factor E(ZN) is increased by the value of the weighted offset E(ZW) (step 1422). Then, if the current value of the sample peak E(P) is greater than or equal to the value of the table peak (step 1424), the gain calibration is ended (step 1416). However, if the sample peak is not greater than or equal to the table peak (step 1424), then the process returns to step 1418, and an iterative loop is executed until the sample peak is greater than or equal to the table peak.

In this manner, the compensating gain setpoint and the compensating gain factor are iteratively increased. Therefore, no multiplication is required.

In the same way, if the table peak is less than the sample peak (step 1414), then the number of data points that are summed is decreased. The sample peak value is decreased by the value of the weighted sample peak (step 1426). The number of sample points for the compensating gain setpoint E(GN) is decreased by the gain adjustment value. In the present method, the gain adjustment value is equal to one (step 1428). The compensating gain factor E(ZN) is decreased by the value of the weighted offset (step 1430). Then, if the current value of the sample peak is less than or equal to the value of the table peak (step 1432), the gain calibration is ended (step 1416). However, if the sample peak is not less than or equal to the table peak (step 1432), then the process returns to step 1426, and an iterative loop is executed until the sample peak is less than or equal to the table peak.

In this manner, the compensating gain setpoint and the compensating gain factor are iteratively decreased. Therefore, no multiplication is required.

Figure 15:
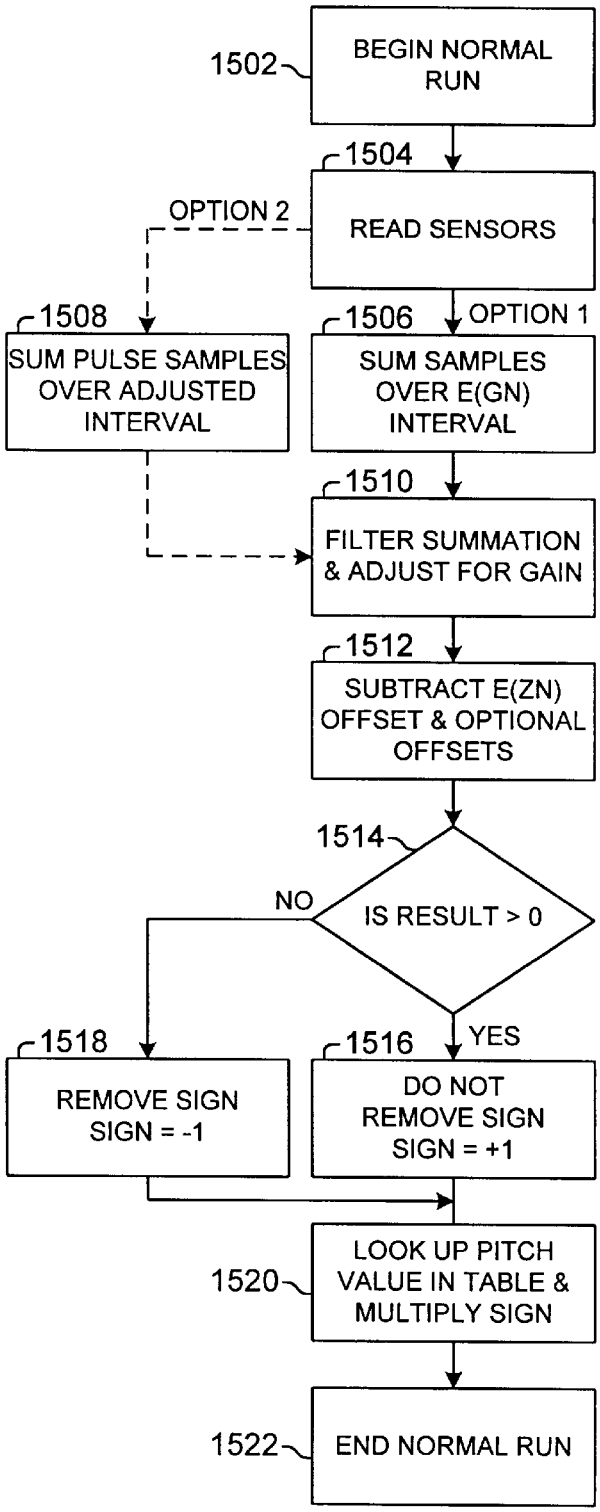
FIG. 15 is a flowchart of a second embodiment of a method of determining a pitch angle using a gain factor, temperature offset, and a roll offset.

The normal run method of the second embodiment is illustrated in FIG. 15. With reference to FIG. 4, when the normal run is implemented (step 1502), the accelerometer sensor 402 reads data samples and transmits the data to the processor 408 via the analog-to-digital converter 406 (step 1504). The processor can implement one of two options. First, the processor 408 can use the simple average summation method and sum the data samples over the compensating gain setpoint E(GN) interval which was determined during the gain calibration (step 1506). Second, the processor 408 can sum delta-sigma pulse samples over an adjusted interval (step 1508). The first option is the preferred method.

After the data samples have been summed, they are averaged to complete the filter process over the compensating gain setpoint E(GN) interval (step 1510). The summed data samples are divided by the compensating gain setpoint value. The compensating gain factor value E(ZN), which was determined in the gain calibration, and any optional offsets including the temperature offset and the roll offset, are subtracted to get a pitch threshold (step 1512).

The pitch threshold is either a positive or a negative value, giving the pitch threshold either a positive sign or a negative sign. If the pitch threshold is greater than zero (step 1514), then the sign of the value is not removed to get an absolute value, and the sign is set to a positive one (step 1516). If the pitch threshold is not greater than zero (step 1514), then the negative sign is removed to get an absolute value, and the sign is set to a negative one (step 1518). The processor 408 looks up the pitch threshold in the pitch table to determine the output code. The processor 408 searches through the pitch table until the amplitude of the pitch threshold is less than the value in the pitch table. The processor 408 the pitch table value and multiplies the pitch table value by the sign (either positive one or negative one) to get the pitch angle (step 1520). The normal run mode is then complete (step 1522). The pitch angle is transmitted to the output interface 412 as an output signal.

It now can be appreciated that the present invention provides a pitch angle of a boring tool independent of roll. The present invention uses a single accelerometer sensor with a single sensitive-axis to read the pitch angle and to provide data samples to other guidance module components for processing. The processing combines simple averaging of the data samples with low pass filtering to reduce noise and roll sensitive offsets. The processor uses a unique combination of gain calibration and compensation techniques, temperature compensation, and roll compensation to provide an accurate pitch angle. Data sampling outputs which are non-uniform are gain-compensated without using variable or test-selected data elements. In addition, usage of the sampling allows the processor to cycle power every half cycle, thus reducing power consumption.

Those skilled in the art will appreciate that variations from the specific embodiments disclosed above are contemplated by the invention. The invention should not be restricted to the above embodiments and is capable of modifications, rearrangements, and substitutions of parts and elements without departing from the spirit and scope of the invention.

What is claimed is:

1. A guidance module for use in the boring tool of a horizontal underground boring assembly, wherein the boring assembly includes an output device for presenting directional information received from the guidance module and wherein the boring tool has a longitudinal axis, the module comprising:

an accelerometer sensor having a single sensitive axis which is aligned parallel to the boring tool axis, the accelerometer sensor adapted to sense a plurality of pitch data samples of the boring tool between a horizontal plane and the axis of the boring tool and to transmit the pitch data samples in a pitch signal;

a temperature sensor adapted to measure temperature near the accelerometer and to transmit the temperature in a temperature signal; and a processor adapted to receive the pitch signal from the accelerometer sensor and the temperature signal from the temperature sensor, to process the temperature in the temperature signal to determine a temperature offset, to process the pitch data samples from the pitch signal with the temperature offset to determine a pitch angle, and to transmit an output signal containing the pitch angle to the output device.

2. The guidance module of claim 1 wherein the module contains only one accelerometer sensor.

3. The guidance module of claim 1 further comprising an input interface adapted to accept processor input signals from an external source and to transmit the processor input signals to the processor.

4. The guidance module of claim 1 further comprising a memory adapted to store data and to transmit the data between the processor and the memory.

5. The guidance module of claim 1 further comprising a memory adapted to store programming and to transmit the programming between the processor and the memory.

6. The guidance module of claim 1 further comprising an output interface adapted to receive the output signal from the processor and to output the output signal to the output device.

7. The guidance module of claim 1 wherein the temperature signal is in an analog format and wherein the module further comprises a converter adapted to receive the temperature signal from the temperature sensor, to convert the temperature signal to a digital format, and to transmit the temperature signal in the digital format to the processor.

8. The guidance module of claim 1 wherein the pitch signal is in an analog format and wherein the module further comprises a converter adapted to receive the pitch signal from the accelerometer sensor, to convert the pitch signal to a digital format, and to transmit the pitch signal in the digital format to the processor.

9. The guidance module of claim 1 wherein the guidance module further comprises a roll sensor adapted to measure a roll angle of the boring tool and to transmit roll angle data in a roll angle signal to the processor and wherein the processor is adapted to process the roll angle data to determine a roll angle offset and to process the pitch data samples with the roll angle offset to determine the pitch angle.

10. The guidance module of claim 9 wherein the roll angle data is in an analog format and wherein the guidance module further comprises a converter adapted to receive the roll angle data from the roll sensor, to convert the roll angle data to a digital format, and to transmit the roll angle data in the digital format to the processor.

11. A boring tool for use in a horizontal underground boring assembly, wherein the boring assembly includes an output device for presenting directional information received from the boring tool and wherein the boring tool has a longitudinal axis, the boring tool comprising:

a guidance module installed in the boring tool, the module comprising:

an accelerometer sensor having a single sensitive axis which is aligned parallel to the boring tool axis, the accelerometer sensor adapted to sense a plurality of pitch data samples of the boring tool between a horizontal plane and the axis of the boring tool and to transmit the pitch data samples in a pitch signal;

a temperature sensor adapted to measure temperature near the accelerometer and to transmit the temperature in a temperature signal; and a processor adapted to receive the pitch signal from the accelerometer sensor and the temperature signal from the temperature sensor, to process the temperature in the temperature signal to determine a temperature offset, to process the pitch data samples from the pitch signal with the temperature offset to determine a pitch angle, and to transmit an output signal containing the pitch angle to the output device.

12. The boring tool of claim 11 wherein the guidance module contains only one accelerometer sensor.

13. The boring tool of claim 11 wherein the guidance module further comprises an input interface adapted to accept processor input signals from an external source and to transmit the processor input signals to the processor.

14. The boring tool of claim 11 wherein the guidance module further comprises a memory adapted to store data and to transmit the data between the processor and the memory.

15. The boring tool of claim 11 wherein the guidance module further comprises a memory adapted to store programming and to transmit the programming between the processor and the memory.

16. The boring tool of claim 11 wherein the guidance module further comprises a roll sensor adapted to measure a roll angle of the boring tool and to transmit roll angle data in a roll angle signal to the processor and wherein the processor is adapted to process the roll angle data to determine a roll angle offset and to process the pitch data samples with the roll angle offset to determine the pitch angle.

17. The boring tool of claim 11 wherein the guidance module further comprises an output interface adapted to receive the output signal from the processor and to output the output signal to the output device.

18. The boring tool of claim 11 wherein the temperature signal is in an analog format and wherein the guidance module further comprises a converter adapted to receive the temperature signal from the temperature sensor, to convert the temperature signal to a digital format, and to transmit the temperature signal in the digital format to the processor.

19. The apparatus of claim 11 wherein the pitch signal is in an analog format and wherein the guidance module further comprises a converter adapted to receive the pitch signal from the accelerometer sensor, to convert the pitch signal to a digital format, and to transmit the pitch signal in the digital format to the processor.

20. A boring assembly for underground horizontal boring, comprising:

a boring tool having a longitudinal axis, wherein the boring tool comprises:

a guidance module, comprising:

an accelerometer sensor having a single sensitive axis which is aligned parallel to with the boring tool axis, the accelerometer sensor adapted to sense a plurality of pitch data samples of the boring tool between a horizontal plane and the axis of the boring tool and to transmit the pitch data samples in a pitch signal;

a temperature sensor adapted to measure temperature near the accelerometer and to transmit the temperature in a temperature signal; and a processor adapted to receive the pitch signal from the accelerometer sensor and the temperature signal from the temperature sensor, to process the temperature in the temperature signal to determine a temperature offset, to process the pitch data samples from the pitch signal with the temperature offset to determine a pitch angle, and to transmit an output signal containing the pitch angle; and a control system comprising:

a drive system adapted to drive the boring tool through the earth;

a steering system adapted to control the direction of the boring tool; and an output device adapted to receive the output signal containing the pitch angle and to present the pitch angle.

21. The boring assembly of claim 20 wherein the guidance module in the boring tool comprises only one accelerometer sensor.

22. The boring assembly of claim 20 wherein the output device is adapted to display the pitch angle visually.

23. The boring assembly of claim 20 wherein the guidance module of the boring tool further comprises an input interface adapted to accept processor input signals from an external source and to transmit the processor input signals to the processor.

24. The boring assembly of claim 20 wherein the guidance module of the boring tool further comprises a memory adapted to store data and to transmit the data between the processor and the memory.

25. The boring assembly of claim 20 wherein the guidance module of the boring tool further comprises a roll sensor adapted to measure a roll angle of the boring tool and to transmit roll angle data in a roll angle signal to the processor and wherein the processor is adapted to process the roll angle data to determine a roll angle offset and to process the pitch data samples with the roll angle offset to determine the pitch angle.

26. The boring assembly of claim 20 wherein the temperature signal is in an analog format and wherein the guidance module in the boring tool further comprises a converter adapted to receive the temperature signal from the temperature sensor, to convert the temperature signal to a digital format, and to transmit the temperature signal in the digital format to the processor.

27. The boring assembly of claim 20 wherein the pitch signal is in an analog format and wherein the guidance module in the boring tool further comprises a converter adapted to receive the pitch signal from the accelerometer sensor, to convert the pitch signal to a digital format, and to transmit the pitch signal in the digital format to the processor.

28. The boring assembly of claim 20 wherein the guidance module of the boring tool further comprises an output interface adapted receive the output signal from the processor and to output the output signal to the control assembly.

29. The boring assembly of claim 28 wherein the output interface is adapted to transmit the output signal over a transmission line to the output device.

30. The boring assembly of claim 28 wherein the output interface comprises a radio frequency transmitter and is adapted to transmit the output signal from the radio frequency transmitter to the output device with a radio frequency signal.

31. A method for determining boring direction when boring underground with a boring assembly having a boring tool with a longitudinal axis, the method comprising:

sensing in an accelerometer sensor pitch data samples representative of a pitch angle of the boring tool between a horizontal plane and the axis of the boring tool;

sensing a temperature sample near the accelerometer;

determining a compensating gain factor;

determining a temperature offset using the temperature sample;

averaging the pitch data samples; and processing the pitch data samples with the temperature offset and the compensating gain factor to determine a pitch angle.

32. The method of claim 31 wherein sensing the pitch data samples comprises sensing the pitch data samples with only one accelerometer sensor.

33. The method of claim 31 wherein the boring assembly includes an output device for presenting directional information, and wherein the method further comprises transmitting the pitch angle to the output device.

34. The method of claim 31 wherein the pitch data samples are in an analog format and wherein the method further comprises converting the pitch data samples to a digital format.

35. The method of claim 31 wherein the temperature sample is in an analog format and wherein the method further comprises converting the temperature sample to a digital format.

36. The method of claim 31 wherein processing the pitch data samples with the temperature offset and the gain calibrating offset to determine the pitch angle comprises:

subtracting the temperature offset and the compensating gain factor from the averaged data samples to get a result having a sign;

determining if the result is positive or negative;

removing the sign if the result is negative and setting the sign to negative;

leaving the sign if the result is positive and setting the sign to positive;

looking up a pitch angle in a pitch lookup table using the result as an index; and multiplying the pitch angle by the sign.

37. The method of claim 31 wherein a number of data samples are sampled and wherein averaging the data samples comprises summing the data samples to get a summation and dividing the summation of the data samples by a value equal to the number of data samples that were sampled.

38. The method of claim 31 wherein the accelerometer sensor has a single sensitive axis and wherein the method further comprises aligning the single sensitive axis parallel to the boring tool axis before sensing in the accelerometer sensor.

39. The method of claim 38 wherein the method further comprises aligning the single sensitive axis coaxial with the boring tool axis before sensing in the accelerometer sensor.

40. The method of claim 31 further comprising:

sensing a roll angle sample of the boring tool;

determining a roll angle offset using the roll angle sample; and processing the pitch data samples with the roll angle offset to determine the pitch angle.

41. The method of claim 40 wherein the roll angle sample is in an analog format and wherein the method further comprises converting the roll angle sample to a digital format.

42. The method of claim 31 further comprising calibrating the accelerometer sensor before sensing the pitch data samples.

43. The method of claim 42 wherein calibrating the accelerometer sensor comprises calibrating the accelerometer sensor with a temperature calibration mode and a gain calibration mode.

44. The method of claim 31 wherein averaging the data samples produces an average result and wherein determining the pitch angle comprises using the relationship wherein the pitch angle is equal to the arcsin of the quantity of the average result minus the temperature offset divided by the compensating gain factor.

45. The method of claim 44 wherein determining the pitch angle further comprises subtracting a roll angle offset.

46. A method for determining boring direction when boring underground with a boring tool having a longitudinal axis, the method comprising:

sensing with only one accelerometer sensor pitch data samples of the boring tool between a horizontal plane and the axis of the boring tool with a reference to a gravity vector, the only one accelerometer having a single sensitive axis; and processing the pitch data samples to determine a pitch angle.

47. The method of claim 46 further comprises aligning the sensitive axis of the only one accelerometer sensor parallel to the axis of the boring tool before sensing with the only one accelerometer sensor.

48. The method of claim 46 further comprising:

sensing a temperature near the only one accelerometer sensor;

using the temperature to determine a temperature offset; and processing the pitch data samples with the temperature offset to determine the pitch angle.

49. The method of claim 48 further comprising:

sensing a roll angle sample of the boring tool;

determining a roll angle offset using the roll angle sample; and processing the pitch data samples with the roll angle offset to determine the pitch angle.

50. The method of claim 49 further comprising:

sensing a roll angle sample of the boring tool;

determining a roll angle offset using the roll angle sample; and processing the pitch data samples with the roll angle offset to determine the pitch angle;

wherein determining the pitch angle comprises using the relationship wherein the pitch angle is equal to the arcsin of the quantity of the average result minus the temperature offset divided by the compensating gain factor minus the roll angle offset.

51. The method of claim 46 further comprising calibrating the only one accelerometer sensor to determine the compensating gain factor and a temperature offset.

52. The method of claim 51 wherein processing the pitch data samples to determine the pitch angle comprises:

averaging the data samples;

adjusting the data samples with the compensating gain factor;

adjusting the data samples with the temperature offset; and determining a pitch angle after the data samples have been averaged, adjusted with the compensating gain factor, and adjusted with the temperature offset.

53. The method of claim 52 wherein processing the pitch data samples to determine the pitch angle further comprises:

subtracting the temperature offset and the compensating gain factor from the filtered data samples to get a result with a sign;

determining if the result is positive or negative;

removing the sign if the result is negative and setting the sign to negative;

leaving the sign if the result is positive and setting the sign to positive;

looking up a pitch angle in a pitch lookup table using the result as an index; and multiplying the pitch angle by the sign.

54. The method of claim 52 wherein averaging the data samples produces an average result and wherein determining the pitch angle comprises using the relationship wherein the pitch angle is equal to the arcsin of the quantity of the average result minus the temperature offset divided by the compensating gain factor.

55. The method of claim 52 wherein a number of data samples are sampled and wherein averaging the data samples comprises summing the data samples to get a summation and dividing the summation of the data samples by a value of the number of data samples that were sampled.

56. A method for boring underground horizontally using a boring assembly comprising a boring tool with a longitudinal axis, the method comprising:

calibrating an accelerometer sensor;

reading a plurality of data samples from the accelerometer sensor;

sensing a temperature near the accelerometer sensor;

filtering the data samples;

adjusting the data samples with a compensating gain factor;

adjusting the data samples with a temperature offset;

determining a pitch angle after the data samples have been filtered, adjusted for the compensating gain factor, and adjusted with the temperature offset.

57. The method of claim 56 wherein only one accelerometer sensor reads the plurality of data samples.

58. The method of claim 56 wherein the boring assembly includes a control system which includes a steering system adapted to control the direction of the boring tool, and wherein the method further comprises:

transmitting to a control system the pitch angle in an output signal; and adjusting the direction of the boring tool after receiving the output signal at the control system.

59. The method of claim 56 further comprising subtracting a roll offset from the data samples.

60. The method of claim 56 wherein adjusting the data samples with the temperature offset comprises subtracting a temperature offset from the data samples.

61. The method of claim 56 wherein adjusting the data samples for compensating gain factor comprises subtracting a compensating gain factor from the data samples.

62. The method of claim 56 wherein determining the pitch angle comprises:

subtracting a temperature offset and a compensating gain factor from the filtered data samples to get a result with a sign;

determining if the result is positive or negative;

removing the sign if the result is negative and setting the sign to negative;

leaving the sign if the result is positive and setting the sign to positive looking up a pitch angle in a pitch lookup table using the result as an index; and multiplying the pitch angle by the sign.

63. The method of claim 56 wherein calibrating the accelerometer sensor on the boring tool to determine an offset comprises determining a compensating gain factor comprising:

reading a first sensor value at a maximum input position and a second sensor value at a minimum input position;

determining an sample peak value of the first sensor value and the second sensor value by dividing by two the quantity of the sensor value at the maximum accelerometer placement minus the sensor value at the minimum input position; and storing the sample peak value in a memory as the compensating gain factor.

64. The method of claim 56 wherein the accelerometer sensor has a single sensitive axis and the method further comprises aligning the single sensitive axis of the accelerometer sensor parallel to the axis of the boring tool before calibrating the accelerometer sensor.

65. The method of claim 64 wherein the accelerometer sensor has a single sensitive axis and the method further comprises aligning the single sensitive axis of the accelerometer sensor coaxial with the axis of the boring tool before calibrating the accelerometer sensor.

66. The method of claim 56 wherein determining the pitch angle comprises using the relationship wherein the pitch angle is equal to the arcsin of the quantity of the average result minus the temperature offset divided by the compensating gain factor.

67. The method of claim 66 further comprising:

sensing a roll angle sample of the boring tool;

determining a roll angle offset using the roll angle sample; and processing the pitch data samples with the roll angle offset to determine the pitch angle;

wherein determining the pitch angle comprises using the relationship wherein the pitch angle is equal to the arcsin of the quantity of the average result minus the temperature offset divided by the compensating gain factor minus the roll angle offset.

68. The method of claim 56 wherein calibrating the accelerometer sensor on the boring tool to determine an offset comprises determining the temperature offset comprising:

placing the accelerometer sensor in a heating/cooling unit with a temperature sensor;

setting a temperature in the heating/cooling unit to a value;

reading the temperature from the temperature sensor;

reading a data sample from the accelerometer sensor if the temperature from the temperature sensor is at a temperature index; and storing the data sample from the accelerometer in a memory and indexing the stored data sample by the temperature from the temperature sensor.

69. The method of claim 68 further comprising:

increasing the temperature in the heating/cooling unit;

determining if the heating/cooling unit has reached a maximum temperature;

incrementing the temperature index if the heating/cooling unit has not reached the maximum temperature;

reading the temperature from the temperature sensor if the heating/cooling unit has not reached the maximum temperature;

reading a data sample from the accelerometer sensor if the temperature from the temperature sensor is at the incremented temperature index and if the heating/cooling unit has not reached the maximum temperature;

storing the data sample from the accelerometer in a memory and indexing the stored data sample by the temperature from the temperature sensor if the heating/cooling unit has not reached the maximum temperature; and ending the temperature calibration if the heating/cooling unit has reached the maximum temperature.

70. The method of claim 56 wherein calibrating the accelerometer sensor on the boring tool to determine an offset comprises determining a roll angle offset comprising:

setting the boring tool to a roll angle index point;

reading a roll sensor to determine a roll angle offset; and storing the roll angle offset by the index point in a memory.

71. The method of claim 70 further comprising:

determining if the boring tool is set at a final index point;

setting the boring tool at a next roll angle index point if the boring tool is not set at the final index point;

reading the roll sensor to determine the roll angle if the boring tool is not set at the final index point;

storing the roll angle offset by the index point in the memory if the boring tool is not set at the final index point; and ending the roll angle calibration if the boring tool is set at the final index point.

72. The method of claim 56 wherein calibrating the accelerometer sensor comprises:

reading a first sensor value at a maximum input position and a second sensor value at a minimum input position;

determining an sample peak value of the first sensor value and the second sensor value;

determining a zero offset of the first sensor value and the second sensor value;

obtaining a gain reference setpoint;

obtaining a reference peak value;

determining a weighted sample peak value;

comparing the sample peak value to the reference peak value; and adjusting the gain reference setpoint to a compensating gain setpoint and adjusting the zero offset to a compensating gain factor if the reference peak value is not equal to the sample peak value.

73. The method of claim 72 wherein reading a plurality of data samples comprises reading a number of data samples that is equal to the compensating gain setpoint.

74. The method of claim 72 wherein filtering the sensor input signals comprises summing the plurality of data samples to get a summation and dividing the summation of the data samples by the compensating gain setpoint.

75. The method of claim 72 further comprising raising the gain reference setpoint to a compensating gain setpoint and raising the zero offset to a compensating gain factor if the reference peak value is greater than the sample peak value.

76. The method of claim 75 wherein raising the gain reference setpoint to the compensating gain setpoint and raising the zero offset to the compensating gain factor comprises setting the compensating gain setpoint to the gain reference setpoint and the compensating gain factor to the zero offset and iteratively raising the compensating gain setpoint by a gain adjustment value and iteratively raising the compensating gain factor by an offset adjustment value by iteratively comparing the reference peak value to the sample peak value raised by a weighted sample peak value and thereby iteratively raising the compensating gain setpoint with the gain adjustment value and iteratively raising the compensating gain factor with the offset adjustment value for each comparison until the sample peak value iteratively raised by the weighted sample peak value is not lower than the reference peak value.

77. The method of claim 72 further comprising lowering the gain reference setpoint to a compensating gain setpoint and lowering the zero offset to a compensating gain factor if the reference peak value is lower than the sample peak value.

78. The method of claim 77 wherein lowering the gain reference setpoint to the compensating gain setpoint and lowering the zero offset to the compensating gain factor comprises setting the compensating gain setpoint to the gain reference setpoint and the compensating gain factor to the zero offset and iteratively lowering the compensating gain setpoint by a gain adjustment value and iteratively lowering the compensating gain factor by an offset adjustment value by iteratively comparing the reference peak value to the sample peak value lowered by a weighted sample peak value and thereby iteratively lowering the compensating gain setpoint with the gain adjustment value and iteratively lowering the compensating gain factor with the offset adjustment value for each comparison until the sample peak value iteratively raised by the weighted sample peak value is not greater than the reference peak value.

* * * * *

UNITED STATES PATENT AND TRADEMARK OFFICE

CERTIFICATE OF CORRECTION

PATENT NO. : 5,880,680

DATED : March 9, 1999

INVENTOR(S) : John C. Wisehart, Austin L. Widener and Jian Jin

It is certified that error appears in the above-identified patent and that said Letters Patent is hereby corrected as shown below:

Column 6, line 27, please delete "()C)" and substitute therefore --(DC)--.

Column 6, line 51, please delete "($m/S^2$)" and substitute therefore --($m/s^2$)--.

Column 15, line 46, please delete "a s" and substitute therefore --as--.

Column 15, line 65, after the word "per" insert --data point--.

Signed and Sealed this

Seventeenth Day of August, 1999

*Attest:*

*Attesting Officer*

Q. TODD DICKINSON

*Acting Commissioner of Patents and Trademarks*